United States Patent [19]

Joseph

[11] Patent Number: 4,645,235

[45] Date of Patent: Feb. 24, 1987

[54] SKI POLE HANDLE

[75] Inventor: Claude Joseph, Sallanches, France

[73] Assignee: Societe Anonyme Kerma, Sallanches, France

[21] Appl. No.: 767,185

[22] Filed: Aug. 19, 1985

[30] Foreign Application Priority Data

Aug. 21, 1984 [FR] France ..... 84 13266

[51] Int. Cl.[4] ..... A63C 11/22

[52] U.S. Cl. ..... 280/821; 16/DIG. 12; 273/81.2

[58] Field of Search .... 16/110 R, DIG. 12, DIG. 19; 135/72; 273/81.2; 280/821, 822

[56] References Cited

U.S. PATENT DOCUMENTS 3,070,370 12/1962 Steiner ..... 273/81.2 X
3,674,267 7/1972 Hollis ..... 273/81.2 X
4,244,602 1/1981 Allsop et al. ..... 280/821

FOREIGN PATENT DOCUMENTS 2732858 2/1978 Fed. Rep. of Germany ..... 280/822
2634656 2/1978 Fed. Rep. of Germany ..... 280/821
PCT0044588 1/1982 PCT Int'l Appl. .

*Primary Examiner*—John A. Pekar
*Assistant Examiner*—Michael Mar
*Attorney, Agent, or Firm*—Karl F. Ross; Herbert Dubno

[57] ABSTRACT

A handle for a ski pole is composed of at least two elements which are assembled together, one of the elements being common to the entire line of handles while the other element can be selected from a group of elements of different sizes to define the ultimate size of the handle. Elements are also provided for assembling them together.

3 Claims, 9 Drawing Figures

SKI POLE HANDLE

CROSS REFERENCE TO RELATED APPLICATION

This application is related to my commonly assigned copending application Ser. No. 704,704 filed Feb. 25, 1985 as a continuation-in-part of then pending application Ser. No. 445,977 filed Dec. 1, 1982 and issued as U.S. Pat. No. 4,508,364 on Apr. 2, 1985.

FIELD OF THE INVENTION

My present invention relates to ski poles and, more particularly, to the handle of a ski pole which may be provided at the upper end thereof and generally is molded from a synthetic resin material with a configuration enabling it to be gripped by the hand of the skier, e.g. with indentations onto which the fingers of the gloved hand may fit with minimum danger of slippage.

BACKGROUND OF THE INVENTION

Ski pole handles of the type mentioned generally comprise a tubular body composed of a plastic or synthetic resin material which is fitted onto the tubular ski pole at the upper end thereof. For economical reasons, the handles of a particular line of ski poles can all be identical in spite of the fact that the hands of the skier who may be using them are of different size and even of different contours in a highly variable manner. A handle which is comfortable for one skier may be gripped only in an awkward manner by another skier.

In some cases this problem has been recognized and the solution has been to provide a line of ski poles which differ not only as to their length but also with respect to the dimensions of their handles.

This, of course, may not completely solve the problem because it certainly is not economical to provide all handle sizes for each manufactured ski pole length. Furthermore, when a series of handles of different sizes must be provided, the fabrication costs for the ski pole line increase significantly, particularly because of the high capital cost of separately molding for all of the different sizes of handles. It is also a disadvantage for the commercialization of the ski poles since the retailer or distributor must stock the large variety.

OBJECTS OF THE INVENTION

It is, therefore, the principal object of the present invention to provide an improved handle for a ski pole whereby the drawbacks outlined above can be obviated.

Another object of this invention is to provide an improved handle for a ski pole which does not require stocking a wide variety of prefabricated ski poles with handles of different dimensions of the expensive fabrication of a large variety of handles to accommodate the comfort of skiers with different hand sizes.

SUMMARY OF THE INVENTION

These objects and others which will become apparent hereinafter are attained, in accordance with the present invention, by providing the handle of the ski pole in two parts or from two elements fabricated separately from one another, one of which may be common to all of a variety of handle sizes while the other is of constant dimensions and is adapted to fit with the first part by appropriate means for assembly, to define the handle. Thus all of the handles, regardless of the fact that they are intended to accommodate hands of different sizes, will have at least one element in common so that it is identical from handle to handle, this element being be associated with a complementary element or part which determines the handle size and dimensions. The identical element, i.e. the one that is common to all handles, may form the element which attaches the handle to the ski pole and can even be provided with a formation which consitutes the lower guard of the handle. The common element, therefore, may constitute a sleeve receiving the upper end of the ski pole. The replaceable element, i.e. the element which can vary in size to suit the needs of the skier, may be a convex member adapted to fit onto the sleeve opposite the sides thereof formed with the finger indentations and, of course, can be selected among from a series of elements of different sizes.

The invention can be provided in various forms. For example, in one embodiment as already described, the common elements for handles of different sizes are preformed with the finger indentations, the lower hand guard and an upper hand guard, while a generally flat seat is provided diametrically opposite the finge indentations. The replaceable interchangeable elements whose dimensions define the ultimate shape and size of the grip can all have flat surfaces receivable in this seat and can be connected to the sleeve by pins, clips or other cooperating means, e.g. screws, enabling assembly of the two parts.

In another embodiment, the base of the handle is a sleeve provided with the lower guard and fitting on the upper end of the ski pole while the replaceable member is likewise a tubular structure having various dimensions of the indentations and rear of the grip and which is fitted over the base sleeve, means being provided to connect the two together. The connection means can be of various sorts, for example, a screw or pin arrangement of the type normally used to affix the grip or handle to the upper end of the ski pole.

The tubular inner element of the handle can be provided with a closed upper end formed with a central orifice which can be traversed by a screw connecting the outer element to the end of the pole.

BRIEF DESCRIPTION OF THE DRAWING

The above and other features, objects and advantages of the present invention will become more readily apparent from the following description, reference being made to the accompanying drawing in which.

SPECIFIC DESCRIPTION

Figure 1:
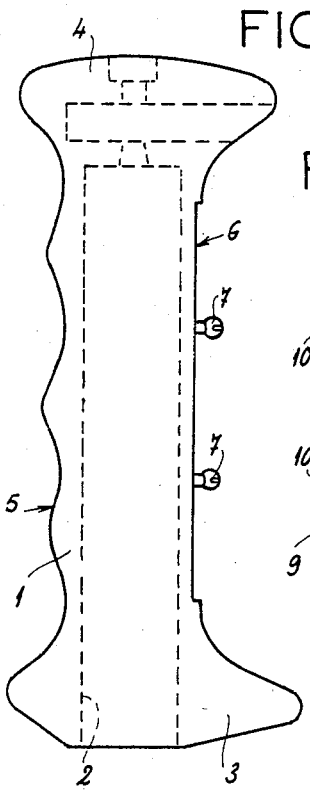
FIG. 1 is an elevational view of a common element for a set of ski pole handles of different sizes, before the application of the element which can be of different dimensions thereto, in accordance with the principles of this invention.

FIG. 1 of the drawing shows a member 1 adapted to form the body of a ski pole handle and molded from a plastic or synthetic resin material with a central passage or bore 2 into which the upper end of the ski pole can fit in a conventional manner.

At its lower end, the member 1 forms a shoulder 3 which can be termed a hand guard, a head 4 being provided at the opposite or upper end of this handle.

Practically over its entire height between the guard 3 and the head 4, the handle member is formed at its front side with an array of indentations 5, as is conventional, to receive the glooved fingers of the skier on the opposite side of the member 1. The latter is formed with a planar surface 6 which forms a seat upon which pins 7 project outwardly. These pins 7 can be molded integrally with member 1. The member 1 constitutes one of the two elements forming the head in accordance with the principles of this invention. With this element, which is common to all of the handles of the particular line of ski poles, there is associated a second element 8, 8*a* which may be selected from a member of premolded elements of different sizes adapted to impart different final dimensions to the handle.

Figure 2:
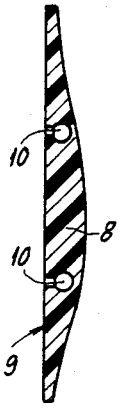
FIG. 2 is a cross sectional view through one of a number of interchangeable elements of different sizes which can be applied to the element of FIG. 1 to form a completed handle for a ski pole.

These elements are also molded from synthetic resin or plastic material and have planar faces 9 which are adapted and dimensioned to abut and fit against the seat 6. The opposite surface of the elements 8 and 8*a* is generally convex so that the various elements can have different degrees of convexity and thickness so that by selection of these elements the transverse dimensions of the handle can be altered to suit the user. For example, the element shown in FIG. 2 is relatively flat and when applied to the element 1 will form a relatively slender handle readily gripped by a small hand. The connection between the member 1 and the complimentary 8 or 8*a* is effected by modifying a plurality of recesses 10 into which the pins 7 can fit snugly to anchor the element 8 or 8*a* to the element 1.

Figure 3:
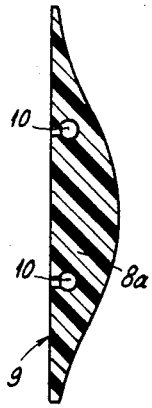
FIG. 3 is a view similar to FIG. 2 of another such element with larger dimensions.
Figure 4:
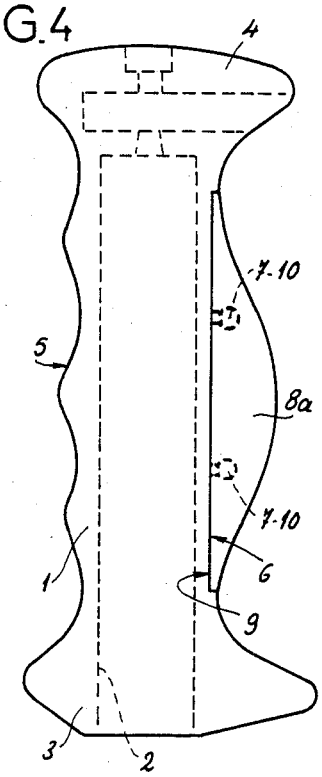
FIG. 4 is a view similar to FIG. 1 but with the element of FIG. 3 in place thereon.
Figure 5:
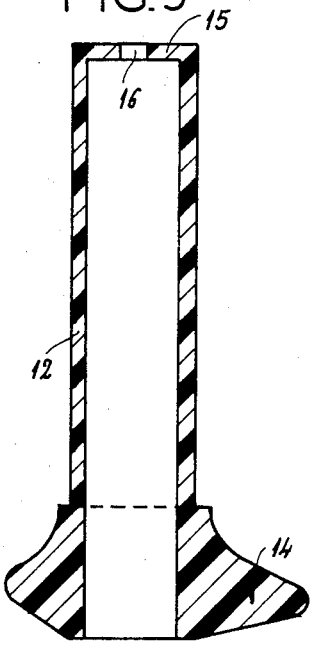
FIG. 5 is a longitudinal cross section through a base element in another embodiment of my invention which can be applied to the upper end of a ski pole.

The element 8*a* of FIG. 3 has a greater thickness and when applied to the element 1 (FIG. 4) forms a handle of greater transverse dimensions, i.e. of larger size to accommodate the larger hand of another skier.

In the embodiment of FIGS. 5–8, the handle is constituted by two tubular elements 12 and 13, respectively, each of which may be integrally molded, preferably injection-molded from synthetic resin material or plastic.

The element 12 is a true tube which is closed at its upper end and is provided with a shoulder 14 at its lower end, the latter forming a base or guard of the handle.

The upper end has a closure formed with a central orifice 16.

The other tubular element 13 which is fabricated in a variety of sizes with different transverse dimensions, has a central passage 17 dimensioned to snugly receive the tube 12. The element 13 terminates in a head 18 which is formed with a lateral passage 19 adapted to receive the two ends of a strap which can form a loop preventing loss of the ski pole, and a central passage 20 through which a ski can pass to simultaneously affix the handle on the upper end of the ski pole, the two elements of the handle together and, of course, as is customary for the loop, the loop to the handle.

Figure 6:
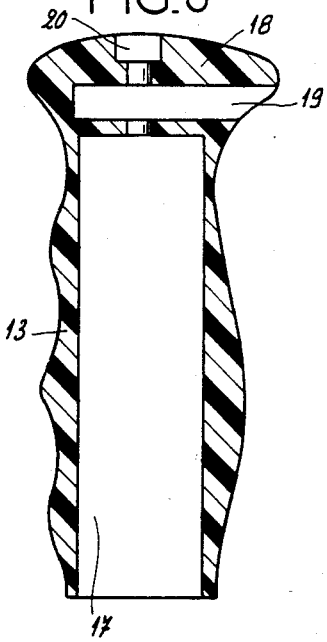
FIG. 6 is a cross section through the element which is selected to define the size of the handle before its application to the element of FIG. 5.
Figure 7:
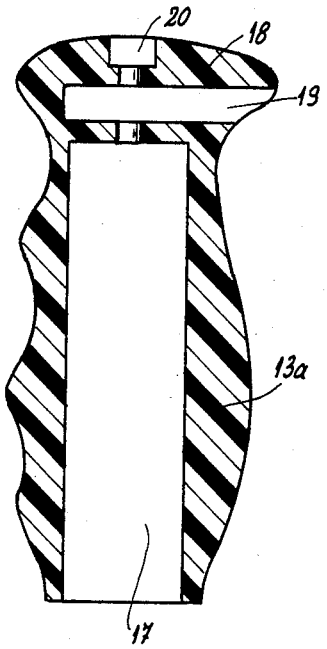
FIG. 7 is a longitudinal section corresponding to FIG. 6 showing a larger handle element which may be substituted for that of FIG. 6.
Figure 8:
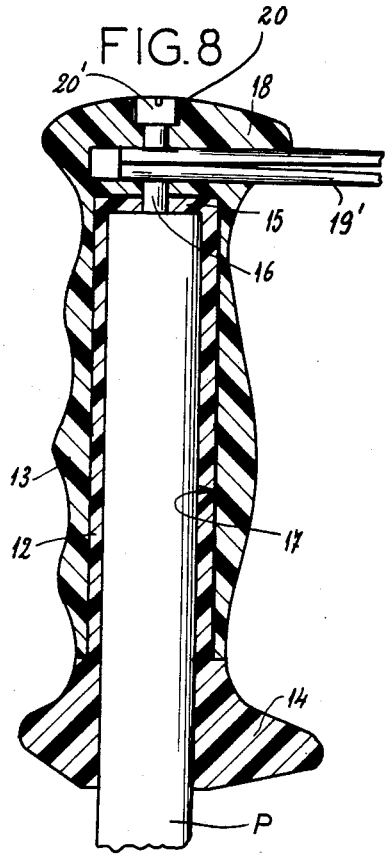
FIG. 8 is an axial section through the assembled handle of the second embodiment although the screw connecting the assembly to the ski pole has not been illustrated.
Figure 9:
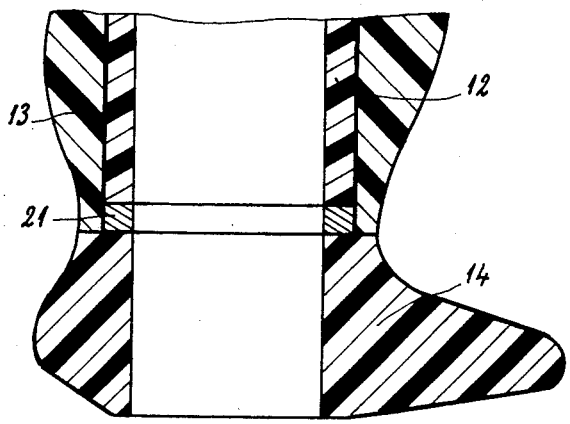
FIG. 9 is a partial longitudinal section through an embodiment of the handle of FIG. 8 showing means which allows control not only of the transverse dimension of the handle but also of the longitudinal dimensions thereof.

The element 18 can have different dimensions for different hands as a comparison of FIGS. 6 and 7 will show and in this case, for the same diameter of the passage 17, with the element of FIG. 6, both the notched and the rear portion are of comparatively small thickness for a small hand while FIG. 7 shows a greater thickness of both portions and hence a greater diameter of the handle to suit a larger hand. FIG. 8 shows the selected element of FIG. 6 assembled with the element of FIG. 5 to provide a relatively small grip. A screw 20' is here shown to traverse the passages 20 and 16, all being anchored in the ski pole P and to hold the ends of the loop 19' in place.

This embodiment offers also a possibility for supplemental control of the length of the handle by providing, for example, the tube 12 and its guard 14 independently from one another so that one or more rings 21 can be interposed between them to change the length of the handle in increments determined by the number of such rings 21 which are used. The rings 21 can have identical or different thicknesses.

I claim:

1. A handle for a ski pole comprising at least two independently fabricated elements, a first of which can be affixed directly to the ski pole and supports the other element, said first element having fixed dimensions and said other elements being selected from a series of second elements having different dimensions, and means on said first and a selected one of said other elements for assembling them together to form the handle with at least transverse dimensions determined by the selected said other element, the first element being a sleeve adapted to fit over the upper end of a ski pole, said sleeve being formed at a forward side with an array of notches adapted to receive fingers of the hand of the skier and along a side opposite said forward side being provided with a seat, said other elements being configured to be receivable in said seat, said seat and a selected one of said elements being interengaged by means for connecting the selected said other element to said seat.

2. The handle defined in claim 1 wherein each of said other elements has a planar surface engageable with said seat and a convex surface opposite said planar surface, said means for assembling including pins projecting from said seat and holes formed in the planar surface of a selected one of said other elements for receiving said pins.

3. The handle defined in claim 1 wherein said sleeve is formed with a shoulder at its lower end forming a hand guard.

* * * * *